US009286872B2

(12) United States Patent
Packouz et al.

(10) Patent No.: US 9,286,872 B2
(45) Date of Patent: Mar. 15, 2016

(54) PORTABLE RECORDING, LOOPING, AND PLAYBACK SYSTEM FOR ACOUSTIC INSTRUMENTS

(71) Applicant: Intelliterran Inc., Miami Beach, FL (US)

(72) Inventors: David Packouz, Miami Beach, FL (US); Albert Podrizki, Miami Beach, FL (US)

( * ) Notice: Subject to any disclaimer, the term of this patent is extended or adjusted under 35 U.S.C. 154(b) by 0 days.

(21) Appl. No.: 14/329,254

(22) Filed: Jul. 11, 2014

(65) Prior Publication Data

US 2015/0013526 A1 Jan. 15, 2015

Related U.S. Application Data

(60) Provisional application No. 61/845,734, filed on Jul. 12, 2013.

(51) Int. Cl.
*G10H 3/18* (2006.01)

(52) U.S. Cl.
CPC ..... *G10H 3/18* (2013.01); *G10H 3/186* (2013.01); *G10H 2250/641* (2013.01)

(58) Field of Classification Search
IPC ..... G10H 1/18,3/186, 2250/641
See application file for complete search history.

(56) References Cited

U.S. PATENT DOCUMENTS

| | | | | | |
|---|---|---|---|---|---|
| 3,691,894 | A * | 9/1972 | Schneider et al. | 84/454 |
| 3,898,397 | A | 8/1975 | Devore et al. | |
| 4,168,647 | A * | 9/1979 | Petillo | 84/731 |
| 4,339,980 | A * | 7/1982 | Hooke et al. | 84/642 |
| D279,905 | S * | 7/1985 | Whited | D17/13 |
| 4,899,636 | A * | 2/1990 | Chiba et al. | 84/454 |
| 5,105,711 | A * | 4/1992 | Barnard | 84/744 |
| 5,308,916 | A * | 5/1994 | Murata et al. | 84/603 |
| 5,637,820 | A * | 6/1997 | Wittman | 84/454 |
| 5,845,240 | A * | 12/1998 | Fielder | 704/201 |
| 6,084,170 | A * | 7/2000 | Laroche | 84/604 |
| 6,166,314 | A * | 12/2000 | Weinstock et al. | 84/483.1 |
| 6,257,535 | B1 * | 7/2001 | Jaing | 248/205.5 |
| 6,574,685 | B1 * | 6/2003 | Schwartz et al. | 710/31 |
| 7,074,998 | B2 * | 7/2006 | Hurwicz | 84/454 |
| 7,220,913 | B2 | 5/2007 | Juszkiewicz et al. | |
| 7,247,789 | B2 * | 7/2007 | Fishman et al. | 84/723 |
| 7,541,536 | B2 * | 6/2009 | Daniel | 84/626 |
| 7,592,533 | B1 * | 9/2009 | Lee | 84/607 |
| 7,636,658 | B2 | 12/2009 | Campbell et al. | |
| 8,455,749 | B1 * | 6/2013 | Gage et al. | 84/730 |
| 8,865,992 | B2 * | 10/2014 | Shavit | 84/615 |

(Continued)

OTHER PUBLICATIONS

ToneWorks Korg. "PXR4 Owners Manual". Apr. 1, 2002. [Retrieved from internet on: 1-10 Sep. 29, 2014) <URL: http://www.manualslib.com/download/258008/Korg-Pxr4.html>.

*Primary Examiner* — David Warren
(74) *Attorney, Agent, or Firm* — Eliezer IP

(57) ABSTRACT

Embodiments of the present invention provide an electronic looping, recording, and playback apparatus. The apparatus may comprise a clamp, enabling the apparatus to be positioned in or on an acoustic instrument, such as an acoustic guitar. The clamp may be used to attach the apparatus to a portion of the acoustic instrument. The apparatus may further comprise, but not be limited to, for example, a speaker, a rechargeable battery, a microphone, a volume knob, an LED indicator light, a switch, and a processing module. The switch may be used to activate the electronic recording, looping, and playback system, much like a pedal in a stompbox configuration.

20 Claims, 3 Drawing Sheets

(56) References Cited

U.S. PATENT DOCUMENTS

| | | | | |
|---|---|---|---|---|
| 2002/0111703 | A1* | 8/2002 | Cole | 700/94 |
| 2003/0171933 | A1* | 9/2003 | Perille | 704/500 |
| 2004/0136549 | A1* | 7/2004 | Pennock et al. | 381/119 |
| 2006/0000347 | A1* | 1/2006 | Preece | 84/741 |
| 2006/0159291 | A1* | 7/2006 | Fliegler et al. | 381/118 |
| 2006/0266200 | A1* | 11/2006 | Goodwin | 84/611 |
| 2007/0234880 | A1* | 10/2007 | Adams et al. | 84/601 |
| 2008/0167740 | A1* | 7/2008 | Merrill | 700/94 |
| 2010/0307325 | A1* | 12/2010 | Appel | 84/743 |
| 2012/0097014 | A1* | 4/2012 | Matsumoto | 84/634 |
| 2013/0030559 | A1* | 1/2013 | Estes | 700/94 |
| 2013/0053993 | A1* | 2/2013 | Setoguchi | 700/94 |
| 2013/0182856 | A1* | 7/2013 | Setoguchi | 381/56 |
| 2013/0291708 | A1* | 11/2013 | Orshan | 84/626 |
| 2014/0202320 | A1* | 7/2014 | White et al. | 84/731 |
| 2015/0013526 | A1* | 1/2015 | Packouz et al. | 84/603 |

* cited by examiner

PORTABLE RECORDING, LOOPING, AND PLAYBACK SYSTEM FOR ACOUSTIC INSTRUMENTS

RELATED APPLICATIONS

The present application claims the benefit of U.S. Provisional Patent Application No. 61/845,734, entitled "Portable Amplified Audio Recorder/Looper System Integrated for an Acoustic Guitar," invented by David Packouz and Albert Podrizki, and filed to the United States Patent and Trademark Office on Jul. 12, 2013. The disclosure of the provisional application is incorporated herein by reference.

TECHNICAL FIELD

The technical field of the present invention relates to electronic recording and looping systems for acoustic instruments.

BACKGROUND

Many musicians use audio-looping systems in order to create rhythmic and melodic accompaniment without the need for another musician. There are several conventional audio-looping systems on the market. However, many of these systems are designed for electric instruments, such as an electric guitar.

For the most part, the conventional systems may comprise an external foot-switch operated device in a "stompbox" format (i.e., a small box that is placed on the floor and consists of a pedal that the musician activates with his or her foot). These devices must often be coupled to an electronic instrument, an external amplification device, and a power supply.

Consequently, the conventional systems may not be convenient for portability, as they may require external equipment and power supplies. Moreover, the conventional systems may be incompatible with acoustic instrument, such an acoustic guitar as they cannot be easily adapted without the need for additional equipment.

BRIEF SUMMARY OF THE INVENTION

This brief summary is provided to introduce a selection of concepts in a simplified form that are further described below in the Detailed Description. This brief summary is not intended to identify key features or essential features of the claimed subject matter. Nor is this brief overview intended to be used to limit the claimed subject matter's scope.

Embodiments of the present invention provide an electronic looping, recording, and playback apparatus. The apparatus may comprise a clamp, enabling the apparatus to be positioned in or on an acoustic instrument, such as an acoustic guitar. The clamp may be used to attach the apparatus to a portion of the acoustic instrument. The portion may be, for example, an edge corresponding to a sound hole of the acoustic instrument.

Still consistent with embodiments of the present invention, the apparatus may further comprise, but not be limited to, for example, a speaker, a rechargeable battery, a microphone, a volume knob, an LED indicator light, a switch, and a processing module. The switch may be used to activate the electronic recording, looping, and playback system, much like a pedal in a stompbox configuration.

The switch may be, for example, an omni-directional switch. A first activation of the switch may cause the apparatus to commence recording the signal received from the microphone, transducer or other sensing device. A second activation of the switch may cause the apparatus to stop recording, and initiate a loop playback through the speaker. The speaker, in turn, may replay the looped recording, thereby enabling the guitarist to have an accompanying track to play along with.

Both the foregoing brief summary and the following detailed description provide examples and are explanatory only. Accordingly, the foregoing brief summary and the following detailed description should not be considered to be restrictive. Further, features or variations may be provided in addition to those set forth herein. For example, embodiments may be directed to various feature combinations and subcombinations described in the detailed description.

BRIEF DESCRIPTION OF THE DRAWINGS

The accompanying drawings, which are incorporated in and constitute a part of this disclosure, illustrate various embodiments of the present disclosure. The drawings contain representations of various trademarks and copyrights owned by the Applicant. In addition, the drawings may contain other marks owned by third parties and are being used for illustrative purposes only. All rights to various trademarks and copyrights represented herein, except those belonging to their respective owners, are vested in and the property of the Applicant. The Applicant retains and reserves all rights in their trademarks and copyrights included herein, and grants permission to reproduce the material only in connection with reproduction of the granted patent and for no other purpose.

In the drawings.

DETAILED DESCRIPTION

Figure 1:
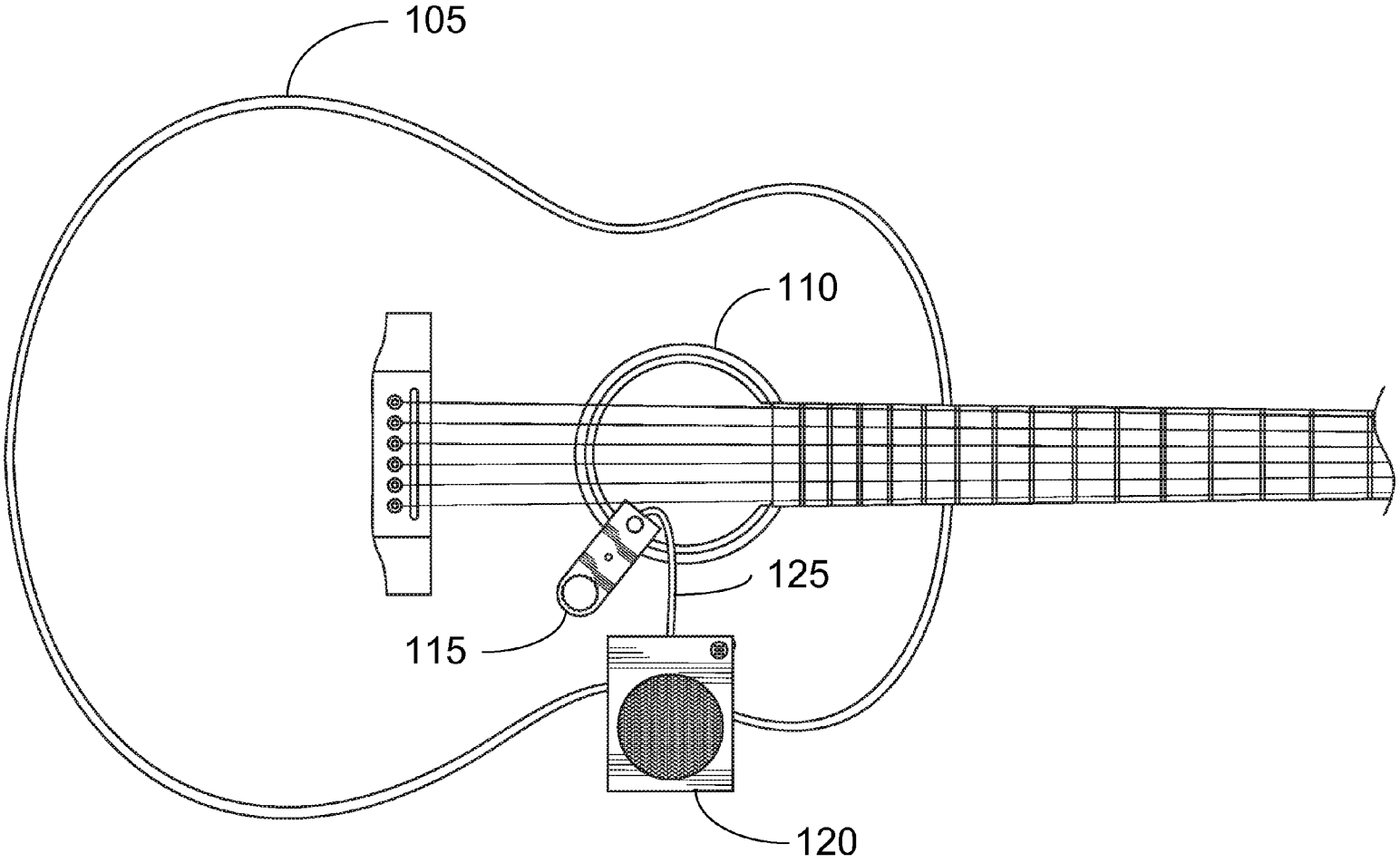
FIG. 1 illustrates an embodiment of the apparatus installed in an acoustic guitar.

The following detailed description refers to the accompanying drawings. Wherever possible, the same reference numbers are used in the drawings and the following description to refer to the same or similar elements. While embodiments of the invention may be described, modifications, adaptations, and other implementations are possible. For example, substitutions, additions, or modifications may be made to the elements illustrated in the drawings, and the methods described herein may be modified by substituting, reordering, or adding stages to the disclosed methods. Accordingly, the following detailed description does not limit the invention. Instead, the proper scope of the invention is defined by the appended claims.

FIG. 1 illustrates the apparatus clamped to an acoustic guitar 105. It should be understood that acoustic guitar 105 in the illustration is used as an example, and that the apparatus may be used in conjunction with other instruments such as, for example, but not limited to, banjos, ukuleles, violins, violas, cellos, pianos, and other instruments to which the apparatus may be adapted to provide the utility disclosed herein.

The apparatus may be comprised of a first portion 115 and a second portion 120. First portion 115 may comprise, but not be limited to, for example, a clamp and a plurality of input switches, a transducer or other sensing device. Second portion 120 may comprise a speaker and a microphone. In some embodiments, the microphone may be integrated into first portion 115. A wire 125 may be used to connect first portion 115 to second portion 120, or they may be connected wirelessly using conventional methods. Either portion may comprise a power supply, such as, for example, a rechargeable battery through a charging port.

The present disclosure anticipates that the apparatus may not always be comprised of two portions. For example, in various embodiments, the apparatus may be configured in more than two portions (e.g., a first portion for a clamp, a second portion for input switches, a third portion for a speaker, and a fourth portion for a microphone—or combinations thereof). In other embodiments, the apparatus may be provided as a single unit with all of the features and functions combined with the clamping mechanism.

The apparatus may be positioned on the inside or outside of acoustic guitar 105. For instance, the apparatus may clamp to an edge corresponding to a sound hole 110 of acoustic guitar 105. The speaker may be positioned externally, as illustrated in FIG. 1. Still consistent with embodiments of the present invention, the speaker may be positioned inside of acoustic guitar 105. The speaker may be placed adjacent to acoustic guitar 105 using, for example, but not limited to, a clamping means or other forms of adhesion (e.g., snaps, screws, Velcro, and the like). In some embodiments, the apparatus may be integrated, or built-in, to acoustic guitar 105.

Figure 2:
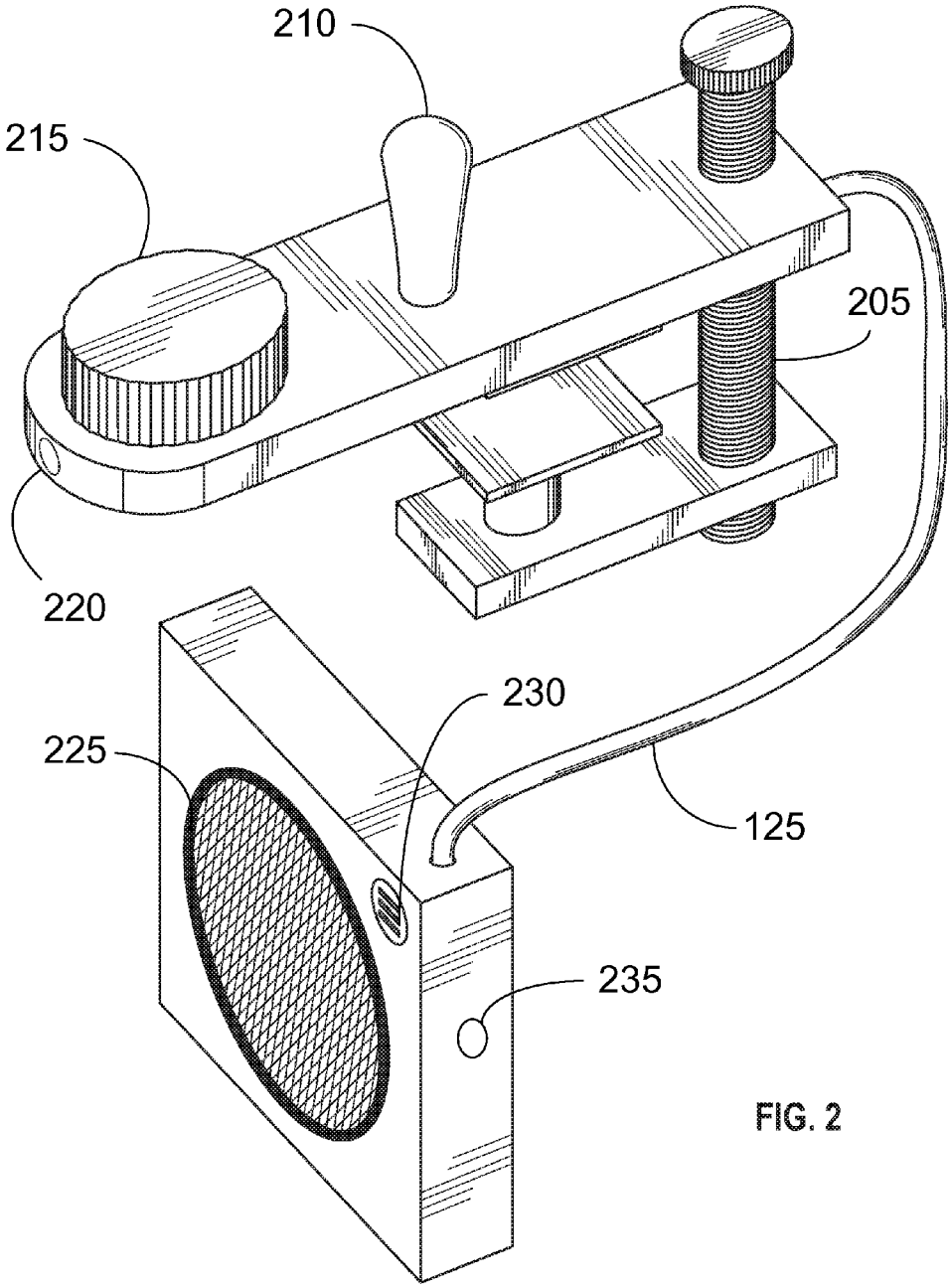
FIG. 2 illustrates a perspective view of the apparatus.

FIG. 2 shows a perspective view of the apparatus (not to scale). As mentioned above, the apparatus may comprise a clamp mechanism 205. Clamp mechanism 205 may be lined with cork or other material to prevent the apparatus from damaging the instrument when the apparatus is clamped thereto. Although FIG. 2 illustrates a representation of clamp mechanism 205 as a screw configured to adjust a distance between clamps, other clamp mechanisms may be used, such as, but not limited to, for example, spring clamps, magnetic clamps, clips, and the like. In various embodiments, first portion 115 may comprise other attachment means such as, but not limited to, for example snaps, screws, and Velcro.

As mentioned above, the apparatus may comprise a switch 210. Switch 210 may be, for example, an omni-directional switch. Activation and deactivation of the switch may control the recording, looping, and playback functions of the apparatus. In various embodiments, a spring may be configured within, for example, first portion 115, configured to cause switch 210 to return to a neutral position after being flipped. This, in turn, may enable a musician to easily activate and deactivate switch 210 with, for example, the up-stroke and/or down-stroke motions of strumming his or her instrument, regardless of the angle. In other embodiments, other control mechanisms may be used in place of the switch, such as, but not limited to, motion detector sensors, touch sensitive pads, buttons, mechanical rollers, or other mechanisms.

A first activation of switch 210 may activate an audio recording, with the recorded signal being received from a microphone 230. A second activation of switch 210 may end the audio recording and begin a looped-playback of the audio recording, with playback being provide through a speaker 225. A third activation of switch 210 may enable an overdubbing (i.e., layering the recorded audio-loop with additional audio received from microphone 230).

Two, rapid successive triggers of switch 210 may end the playback. An activation of switch 210 subsequent to the end-playback trigger may restart the playback. Then, another activation of switch 210 may enable an overdubbing. Still consistent with embodiments of the present invention, holding down switch 210 for a period of time may clear the memory of the apparatus (e.g., the recorded audio playback as stored on an internal storage device such as, for example, flash or other solid-state random access memory). In some embodiments, holding down switch 210 may only clear the most recently recorded layer (e.g., an overdubbed recording).

The audio recording, looping, and playback may be operated by an on-board processing module comprising a processing unit and a memory storage coupled thereto. Details regarding the processing module are disclosed with reference to FIG. 3.

The apparatus may further comprise a volume knob 215. Volume knob 215 may be configured to adjust the volume of the playback through speaker 225. In various other embodiments, volume knob 215, or an additional volume knob, may be used to control a sensitivity of microphone 230, and/or the volume of the recorded overdub layers.

Embodiments of the present invention may provide a port 220 integrated into the apparatus. Port 220 may comprise, for example, but not be limited to, an external audio jack (e.g., ¼ inch or ⅛ inch) or a digital communication port (e.g., universal serial bus or similar). In some embodiments, port 220 may be configured as an input to the apparatus, while in other embodiments port 220 may be configured as an output. For example, port 220 may be configured to allow additional audio to be played through the apparatus (e.g., speaker 225) as accompaniment, or port 220 may be configured to provide integrated digital effects to alter the sound of the played back audio. In other embodiments, a wireless connection such as Bluetooth, Wi-Fi, or other protocol may replace the function of the port.

In various embodiments, the apparatus may comprise a light emitting diode (LED) indicator 235. A color of LED 235 may indicate the operating mode of the apparatus. For example, LED 235 may emit a first color (e.g., red) to indicate a recording mode, a second color (e.g., yellow) to indicate an overdub mode, and a third color (e.g., green) to indicate a playback mode. In other embodiments a liquid-crystal display (LCD) screen, or other type of display device, may replace the function of the LED indicator.

Still consistent with embodiments of the present invention, the apparatus may comprise an integrated tuner to allow the musician to use the device to tune his or her instrument. Other embodiments of the apparatus may comprise a foot-operated pedal or switch that is connected to the apparatus to allow foot control instead of the hand operated switch. Still other embodiments of the present invention may contain integrated digital effects used to change the characteristics of the recorded audio.

Figure 3:
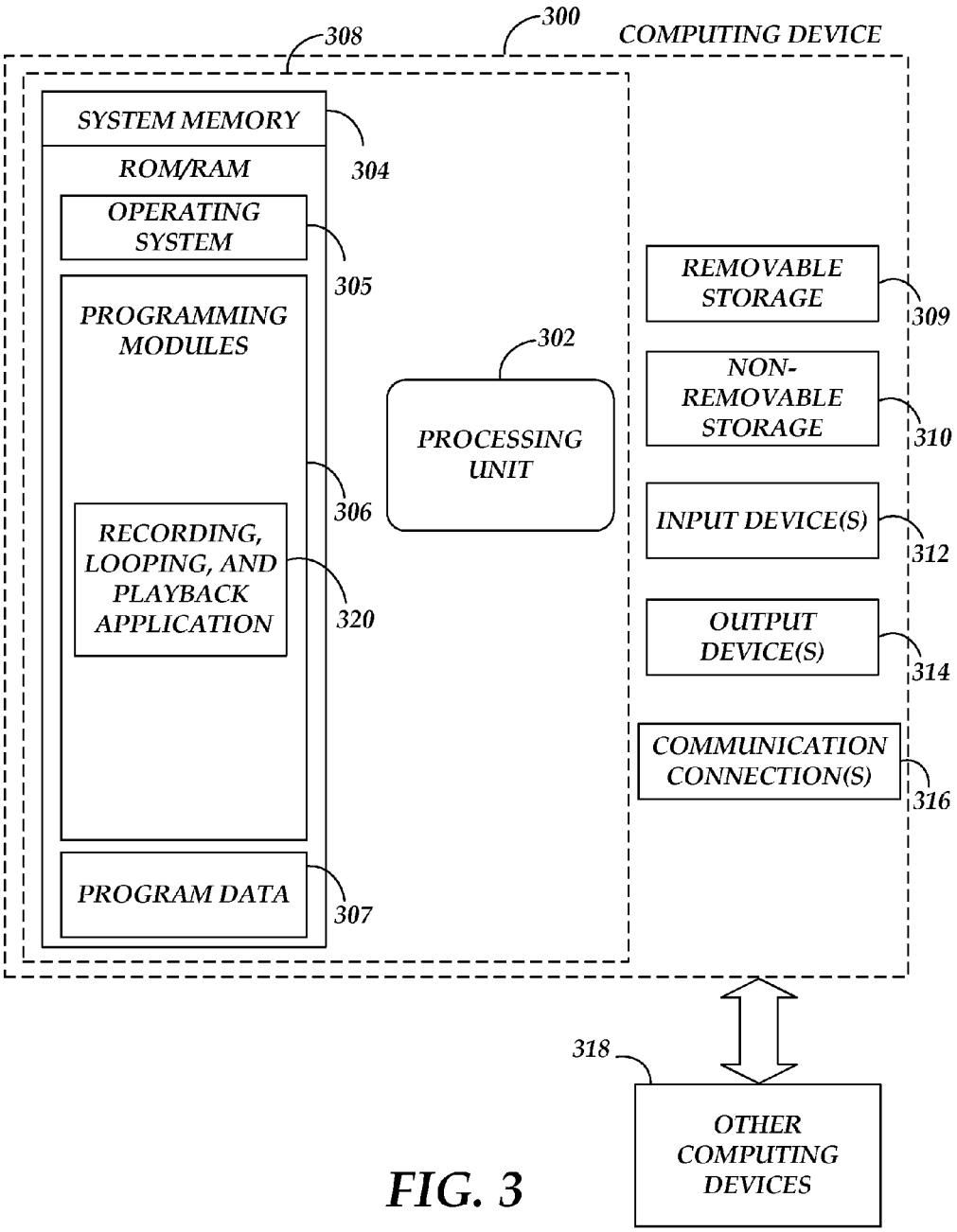
FIG. 3 illustrates a computing device that may be embedded into the apparatus.

FIG. 3 is a block diagram of a system including computing device 300. Computing device 300 may be a micro-embedded processing module integrated into the apparatus. The processing module may comprise a storage device and firmware for operating the apparatus in accordance to the present disclosure. Computing device 300 may further comprises an Analog-to-Digital (A/D) converter and a Digital-to-Analog (D/A) converter, as well as a digital signal processing (DSP) module. The A/D, D/A, and DSP modules may comprise hardware and software components.

Any suitable combination of hardware, software, or firmware may be used to implement the memory storage and processing unit. For example, the memory storage and processing unit may be implemented with computing device 300 or any of other computing devices 318, in combination with computing device 300. The aforementioned system, device, and processors are examples and other systems, devices, and processors may comprise the aforementioned memory storage and processing unit, consistent with embodiments of the invention.

With reference to FIG. 3, a system consistent with an embodiment of the invention may include a computing device, such as computing device 300. In a basic configuration, computing device 300 may include at least one processing unit 302 and a system memory 304. Depending on the configuration and type of computing device, system memory 304 may comprise, but is not limited to, volatile (e.g. random access memory (RAM)), non-volatile (e.g. read-only memory (ROM)), flash memory, or any combination. System memory 304 may include operating system 305, one or more programming modules 306, and may include a program data 307. Operating system 305, for example, may be suitable for controlling computing device 300's operation. In one embodiment, programming modules 306 may include a recording module, looping module, a playback module, a DSP module, and A/D and D/A conversion module. Furthermore, embodiments of the invention may be practiced in conjunction with a graphics library, other operating systems, or any other application program and is not limited to any particular application or system. This basic configuration is illustrated in FIG. 3 by those components within a dashed line 308.

Computing device 300 may have additional features or functionality. For example, computing device 300 may also include additional data storage devices (removable and/or non-removable) such as, for example, magnetic disks, optical disks, or tape. Such additional storage is illustrated in FIG. 3 by a removable storage 309 and a non-removable storage 310. Computer storage media may include volatile and nonvolatile, removable and non-removable media implemented in any method or technology for storage of information, such as computer readable instructions, data structures, program modules, or other data. System memory 304, removable storage 309, and non-removable storage 310 are all computer storage media examples (i.e., memory storage.) Computer storage media may include, but is not limited to, RAM, ROM, electrically erasable read-only memory (EEPROM), flash memory or other memory technology, or any other medium which can be used to store information and which can be accessed by computing device 300. Any such computer storage media may be part of device 300.

Output device(s) 314 such as a display (e.g., LED 220) and speakers (e.g. speaker 225) maybe included. Input devices may include switch 210 and microphone 230. The aforementioned devices are examples and others may be used.

Computing device 300 may also contain a communication connection 316 that may allow device 300 to communicate with other computing devices 318, such as over a network in a distributed computing environment, for example, an intranet or the Internet. Communication connection 316 is one example of communication media. Communication media may typically be embodied by computer readable instructions, data structures, program modules, or other data in a modulated data signal, such as a carrier wave or other transport mechanism, and includes any information delivery media. The term "modulated data signal" may describe a signal that has one or more characteristics set or changed in such a manner as to encode information in the signal. By way of example, and not limitation, communication media may include wired media such as a wired network or direct-wired connection, and wireless media such as acoustic, radio frequency (RF), infrared, and other wireless media (e.g., Wi-Fi or Bluetooth communications protocol). The term computer readable media as used herein may include both storage media and communication media.

As stated above, a number of program modules and data files may be stored in system memory 304, including operating system 305. While executing on processing unit 302, programming modules 306 (e.g. recording, looping, and playback application 320) may perform processes including, for example, one or more switch activations as described above. The aforementioned process is an example, and processing unit 302 may perform other processes. Other programming modules that may be used in accordance with embodiments of the present invention may include electronic mail and contacts applications, word processing applications, spreadsheet applications, database applications, slide presentation applications, drawing or computer-aided application programs, etc.

Generally, consistent with embodiments of the invention, program modules may include routines, programs, components, data structures, and other types of structures that may perform particular tasks or that may implement particular abstract data types. Moreover, embodiments of the invention may be practiced with other computer system configurations, including hand-held devices, multiprocessor systems, microprocessor-based or programmable consumer electronics, minicomputers, mainframe computers, and the like. Embodiments of the invention may also be practiced in distributed computing environments where tasks are performed by remote processing devices that are linked through a communications network. In a distributed computing environment, program modules may be located in both local and remote memory storage devices.

Furthermore, embodiments of the invention may be practiced in an electrical circuit comprising discrete electronic elements, packaged or integrated electronic chips containing logic gates, a circuit utilizing a microprocessor, or on a single chip containing electronic elements or microprocessors. Embodiments of the invention may also be practiced using other technologies capable of performing logical operations such as, for example, AND, OR, and NOT, including but not limited to mechanical, optical, fluidic, and quantum technologies. In addition, embodiments of the invention may be practiced within a general purpose computer or in any other circuits or systems.

Embodiments of the invention, for example, may be implemented as a computer process (method), a computing system, or as an article of manufacture, such as a computer program product or computer readable media. The computer program product may be a computer storage media readable by a computer system and encoding a computer program of instructions for executing a computer process. The computer program product may also be a propagated signal on a carrier readable by a computing system and encoding a computer program of instructions for executing a computer process. Accordingly, the present invention may be embodied in hardware and/or in software (including firmware, resident software, micro-code, etc.). In other words, embodiments of the present invention may take the form of a computer program product on a computer-usable or computer-readable storage medium having computer-usable or computer-readable program code embodied in the medium for use by or in connection with an instruction execution system. A computer-usable or computer-readable medium may be any medium that can contain, store, communicate, propagate, or transport the program for use by or in connection with the instruction execution system, apparatus, or device.

The computer-usable or computer-readable medium may be, for example, but not limited to, an electronic, magnetic, optical, electromagnetic, infrared, or semiconductor system, apparatus, device, or propagation medium. More specific computer-readable medium examples (a non-exhaustive list), the computer-readable medium may include the following: an electrical connection having one or more wires, a portable computer diskette, a random access memory (RAM), a read-only memory (ROM), an erasable programmable read-only memory (EPROM or Flash memory), and an optical fiber.

Embodiments of the present invention, for example, are described above with reference to block diagrams and/or operational illustrations of methods, systems, and computer program products according to embodiments of the invention. The functions/acts noted in the blocks may occur out of the order as shown in any flowchart. For example, two blocks shown in succession may in fact be executed substantially concurrently or the blocks may sometimes be executed in the reverse order, depending upon the functionality/acts involved.

While certain embodiments of the invention have been described, other embodiments may exist. Furthermore, although embodiments of the present invention have been described as being associated with data stored in memory and other storage mediums, data can also be stored on or read from other types of computer-readable media, such as secondary storage devices, like hard disks, floppy disks, or a CD-ROM, a carrier wave from the Internet, or other forms of RAM or ROM. Further, the disclosed methods' stages may be modified in any manner, including by reordering stages and/or inserting or deleting stages, without departing from the invention.

All rights including copyrights in the code included herein are vested in and the property of the Applicant. The Applicant retains and reserves all rights in the code included herein, and grants permission to reproduce the material only in connection with reproduction of the granted patent and for no other purpose.

While the specification includes examples, the invention's scope is indicated by the following claims. Furthermore, while the specification has been described in language specific to structural features and/or methodological acts, the claims are not limited to the features or acts described above. Rather, the specific features and acts described above are disclosed as example for embodiments of the invention.

The invention claimed is:

1. An apparatus comprising:

a clamp configured to attach the apparatus to an acoustic instrument;

a processing module configured to:

record an audio signal received from a microphone; and cause a looped playback of the recorded signal;

a switch configured to operate the processing module, the switch being configured to attach to the acoustic instrument via the clamp;

a microphone configured to provide a signal to the processing module; and a speaker configured to playback a signal, the signal being one of the following: the recorded signal and a processed signal.

2. The apparatus of claim 1, further comprising a volume knob configured to control a volume of playback.

3. The apparatus of claim 1, further comprising a light emitting diode (LED) operative to provide an indication of a state of the apparatus.

4. The apparatus of claim 1, further comprising a port configured for at least one of the following:

receiving a signal to the apparatus, and providing a power supply to the apparatus.

5. The apparatus of claim 1, wherein the switch is an omni-directional switch configured to be operated at any angle, and attach to the acoustic instrument via the clamp at a location enabling a musician to activate and deactivate the switch with a playing motion of the acoustic instrument.

6. The apparatus of claim 1, wherein a first activation of switch is configured to cause a recording of the audio signal.

7. The apparatus of claim 6, wherein a second activation of switch is configured to cause a looped-playback of the recorded audio signal.

8. The apparatus of claim 7, wherein a third activation of switch is configured to cause an overdubbing of the recorded audio signal.

9. The apparatus of claim 1, wherein a first portion of the apparatus comprises the switch.

10. The apparatus of claim 9, wherein the second portion of the apparatus comprises the speaker.

11. An apparatus comprising:

a clamp configured to attach the apparatus to an acoustic instrument;

a processing module configured to:

record an audio signal received from a microphone; and cause a looped playback of the recorded signal;

a switch configured to:

operate the processing module, and attach to the acoustic instrument via the clamp at a location enabling a musician to operate the switch with a playing motion of the acoustic instrument;

a microphone configured to provide a signal to the processing module; and a speaker configured to attach to the acoustic instrument and configured to play back a signal, the signal being one of the following: the recorded signal and a processed signal.

12. The apparatus of claim 11, further comprising a volume knob configured to control a volume of playback.

13. The apparatus of claim 11, further comprising a light emitting diode (LED) operative to provide an indication of a state of the apparatus.

14. The apparatus of claim 11, further comprising a port configured for at least one of the following:

receiving a signal to the apparatus, and providing a power supply to the apparatus.

15. The apparatus of claim 11, wherein the switch is an omni-directional switch configured to be operated at any angle.

16. The apparatus of claim 11, wherein a first activation of switch is configured to cause a recording of the audio signal.

17. The apparatus of claim 16, wherein a second activation of switch is configured to cause a looped-playback of the recorded audio signal.

18. The apparatus of claim 17, wherein a third activation of switch is configured to cause an overdubbing of the recorded audio signal.

19. An apparatus comprising:

a processing module configured to:

record an audio signal received from a microphone; and cause a looped playback of the recorded signal;

a switch configured to operate the processing module;

a microphone configured to provide a signal to the processing module;

a speaker configured to attach to at least one of the following: the interior of the acoustic instrument and the exterior of the acoustic instrument, the processing module being configured to cause a play back, via the speaker, of at least one of the following: the recorded signal and a processed signal; and a clamp comprising a housing configured to house the processing module, the switch, the microphone, and the speaker to the acoustic instrument, the clamping attaching said housing to the acoustic instrument.

20. The apparatus of claim 19, wherein the switch is an omni-directional switch configured to be operated at any angle.

* * * * *